US009033169B2

(12) United States Patent
McPherson

(10) Patent No.: US 9,033,169 B2
(45) Date of Patent: May 19, 2015

(54) TAMPER-EVIDENT CLOSURE

(71) Applicant: Obrist Closures Switzerland GmbH, Reinach (CH)

(72) Inventor: Alexander Donald Meiklem McPherson, Falkirk (GB)

(73) Assignee: Obrist Closures Switzerland GmbH, Reinach (CG)

( * ) Notice: Subject to any disclaimer, the term of this patent is extended or adjusted under 35 U.S.C. 154(b) by 37 days.

(21) Appl. No.: 13/824,981

(22) PCT Filed: Nov. 8, 2012

(86) PCT No.: PCT/GB2012/052780

§ 371 (c)(1),
(2) Date: Mar. 21, 2013

(87) PCT Pub. No.: WO2013/068750

PCT Pub. Date: May 16, 2013

(65) Prior Publication Data

US 2014/0048537 A1 Feb. 20, 2014

(30) Foreign Application Priority Data

Nov. 8, 2011 (GB) ..... 1119311.7

(51) Int. Cl.
*B65D 41/48* (2006.01)
*B65D 41/62* (2006.01)
(Continued)

(52) U.S. Cl.
CPC .... *B65D 41/3428* (2013.01); *B65D 2101/0023* (2013.01); *B65D 51/18* (2013.01); *B65D 49/04* (2013.01); *B65D 55/02* (2013.01); *B65D 2101/0038* (2013.01)

(58) Field of Classification Search
USPC ..... 215/254, 256, 258, 901; 220/254.9, 220/254.1, 255, 255.1, 270, 276, 345.2, 220/351, 345.4
See application file for complete search history.

(56) References Cited

U.S. PATENT DOCUMENTS 3,871,545 A * 3/1975 Bereziat ..... 215/249
6,321,924 B1 * 11/2001 Yurkewicz et al. ..... 215/251
(Continued)

FOREIGN PATENT DOCUMENTS

EP 1717160 A1 11/2006
FR 2722478 A1 1/1996
(Continued)

OTHER PUBLICATIONS

Intellectual Property Office of Great Britain, Search Report of British Patent Application No. GB1119311.7, Feb. 23, 2012, 4 pages.
(Continued)

*Primary Examiner* — Jeffrey Allen
*Assistant Examiner* — Jennifer Castriotta
(74) *Attorney, Agent, or Firm* — Alleman Hall McCoy Russell & Tuttle LLP

(57) ABSTRACT

A tamper-evident closure for a container comprises a first portion and a second portion, the first portion being connected or connectable to the second portion and removable therefrom. The closure is movable upon a first opening from a first position in which the portions are in a first relative relation to a second position in which they are in a second relative relation. The closure comprises means for preventing the portions from returning to the first position. The closure comprises a removable retention member which attaches the first and second portions together such that the member must be removed before the portions can be separated from each other.

19 Claims, 6 Drawing Sheets

(51) Int. Cl.

| | |
|---|---|
| ***B65D 47/14*** | (2006.01) |
| ***B65D 47/36*** | (2006.01) |
| ***B65D 41/34*** | (2006.01) |
| ***B65D 51/18*** | (2006.01) |
| ***B65D 49/04*** | (2006.01) |
| ***B65D 55/02*** | (2006.01) |

(56) References Cited

U.S. PATENT DOCUMENTS

| | | | | |
|---|---|---|---|---|
| 6,908,013 | B2 * | 6/2005 | Thomson et al. | 222/153.06 |
| 7,703,642 | B2 * | 4/2010 | Scott | 222/522 |

FOREIGN PATENT DOCUMENTS

| | | | |
|---|---|---|---|
| GB | 1408797 | | 10/1975 |
| GB | 2158424 | A | 11/1985 |
| GB | 2450940 | A | 1/2009 |
| WO | 2006117505 | A1 | 11/2006 |
| WO | 2008110917 | A1 | 9/2008 |
| WO | 2009010722 | A1 | 1/2009 |
| WO | 2009128095 | A1 | 10/2009 |
| WO | 2009141581 | A1 | 11/2009 |

OTHER PUBLICATIONS

European Patent Office, International Search Report and Written Opinion of PCT/GB2012/052780, Feb. 27, 2013, 14 pages.

* cited by examiner

TAMPER-EVIDENT CLOSURE

CROSS-REFERENCE TO RELATED APPLICATIONS

The present application is the U.S. National Phase of International PCT Application Serial No. PCT/GB2012/052780, entitled "A Tamper-Evident Closure," filed Nov. 8, 2012, which claims priority to Great Britain Application No. 1119311.7, filed Nov. 8, 2011, each of which are hereby incorporated by reference in their entirety for all purposes.

The present invention relates generally to a closure for a container and particularly to a closure with means for indicating that the closure has been opened at least once.

There is an increasing demand for tamper-indicating systems which ensure that a container is not re-filled with non-original contents. Whilst it is relatively easy to produce some form of tamper-evidence, it is much more difficult to provide tamper-evidence which cannot be either overcome without causing the tamper-evidence system to activate, or activated and then returned to a visually identical state so as to appear non-activated.

A particularly useful method of providing tamper-evidence is to use a system in which a closure is initially located into a first position, but once removed can only be returned to a second position which is visually distinct from the first position. For example, U.S. Pat. No. 5,738,231 describes a closure with a part which is moved during the opening process so that following opening it cannot pass back over a projection on the container finish. The result is that the closure can only return to a position in which it is axially displaced with respect to its original position.

Document WO02/096771 describes a closure with a first portion with inner and outer parts, and a second portion. Initially a section of the inner part of the first portion protrudes below the level of the second portion which is formed so as to have a reduced circumference. When the first portion is removed the section of the inner part is pulled from under the area of reduced circumference on the second portion. After removal the inner part of the first portion and the area of reduced circumference on the second portion retain their original dimensions, so that if the first portion is reapplied the inner part can no longer pass under the area of reduced circumference.

Documents WO2005/049449 and WO2006/117505 describe a tamper-evident closure with a first portion including inner and outer parts, and a second portion. The outer part is movable relative to the inner part from a first position in which the outer part is immediately adjacent the second portion to a second position in which there is an unobstructed gap therebetween. The inner and outer parts are adapted to become irreversibly locked in the second position so that the outer part cannot be moved back to the first position to close the gap so as to provide an irreversible event which gives evidence of opening.

The present invention seeks to provide improvements over the prior art.

According to a first aspect there is provided a tamper-evident closure for a container, the closure comprising a first portion and a second portion, the first portion being connected or connectable to the second portion and removable therefrom, the closure movable upon a first opening from a first position in which the portions are in a first relative relation to a second position in which they are in a second relative relation, the closure comprising means for preventing the portions from returning to the first position, in which the closure comprises a removable retention member which attaches the first and second portions together such that the member must be removed before the portions can be separated from each other.

According to a further aspect there is provided a tamper-evident closure for a container, the closure comprising a first portion including inner and outer parts, and a second portion, the first portion being connected or connectable to the second portion and removable therefrom, the inner and outer parts being movable upon a first opening of the closure from the first position to a second position in which there is a gap between at least part of the first and second portions, the closure comprising means for preventing the first portion from returning to the first position so as to maintain the gap, the closure comprising a removable tamper-evident member which attaches the first and second portions together and holds the first portion captive such that the member must be removed before the first portion is removable.

According to a further aspect there is provided a tamper-evident closure for a container, the closure comprising a first portion including inner and outer parts and a second portion. The portions are provided in a shell which is separable into a first and second part, the outer part is movable relative to the inner part from a first position in which the first and second shell parts are adjacent each other to a second position in which there is a gap therebetween, the closure comprises locking means for locking the closure in the second position upon a first opening so that the gap cannot easily be closed, the closure further comprising a removable tear-band which secures the first and second portions together and arranged such that when the closure is in the second position the band must be removed before the first portion is removable from the second portion.

A tamper-evident closure for a container, the closure comprising a first portion including inner and outer parts, and a second portion, wherein the outer part is movable relative to the inner part from a first position in which the outer part is immediately adjacent the second portion to a second position in which there is an unobstructed gap therebetween, and wherein the inner and outer parts are adapted to become irreversibly locked in the second position so that the outer part is not movable back to the first position to close the gap, and the closure further comprising a removable lock member which secures the first and second portions together and which is removable after the closure has been moved to the second position to allow removal of the first portion from the second portion.

Closures formed with inner and outer parts may include means for preventing the inner part from moving relative to the second portion until the other part has reached the second position. If the inner part can move relative to the second portion before the outer part has reached its second position (to generate the gap) there is a risk that the closure could be returned to a closed position without the gap having been generated. The present invention may be configured to prevent this.

The lock or tamper-evident member may be caused to move from a first, retracted position to a second, extended position as the closure moves from the first to the second position to facilitate removal thereof.

In the first position the member may be concealed and in the second position the member may be revealed.

The closure may comprise a shell. A metal (such as aluminium) shell, cowl or the like may be provided to house the working components. The gap may be formed in the shell. The first and second portions may include respective first and second shell parts between which the gap is formed. The shell parts may be joined by a line of weakness when the closure is in the unopened state. For example a frangible line may be provided in the shell, the gap being formed between adjacent peripheries of two shell parts along which the line extends.

The gap may be obstructed. Alternatively the gap may be unobstructed. By 'unobstructed' is meant there is no obstruction at or through the gap. The closure thereby does not rely on an obstructing member becoming trapped at or in the shell gap. By forming an unobstructed gap it is not possible to defeat the tamper-evidence by a simple cutting operation through the gap. In other words, the locking mechanism may be remote from the gap.

The second portion may be attachable to a container. For example the second portion may be attachable to the mouth and neck region of a container. In some embodiments the second portion may be snap-fitable onto a container. Roll-on-pilfer-proof (ROPP) arrangements are also contemplated.

The second portion may comprise or include a pouring fitment.

The closure may further comprise a non-return valve. Certain industries, in particular the spirits industry, demand additional measures to prevent tampering. In-bore fitments such as non-return fitments are often fitted to containers to prevent re-filling regardless of other tamper-evidence measures.

The closure may include a ratchet arrangement for preventing return to the first position, for example by locking inner and outer parts in the second position. A ratchet arrangement is a simple and efficient method of irreversibly locking the inner and outer parts together. Advantageously the locking means which initially hold the inner part on the body may subsequently prevent, or help prevent, the outer part returning to the first position.

The body part may include formations, such as screw threads, for engagement on the container or in-bore fitment as appropriate. In such cases the cap ratchet arrangement or other locking mechanism may be located above the formations so as to increase the difficulty in accessing and tampering with the locking arrangement.

The present invention also provides in combination a closure as described herein and a container.

The present invention will now be more particularly described, by way of example, with reference to the accompanying drawings, in which.

Figure 1:
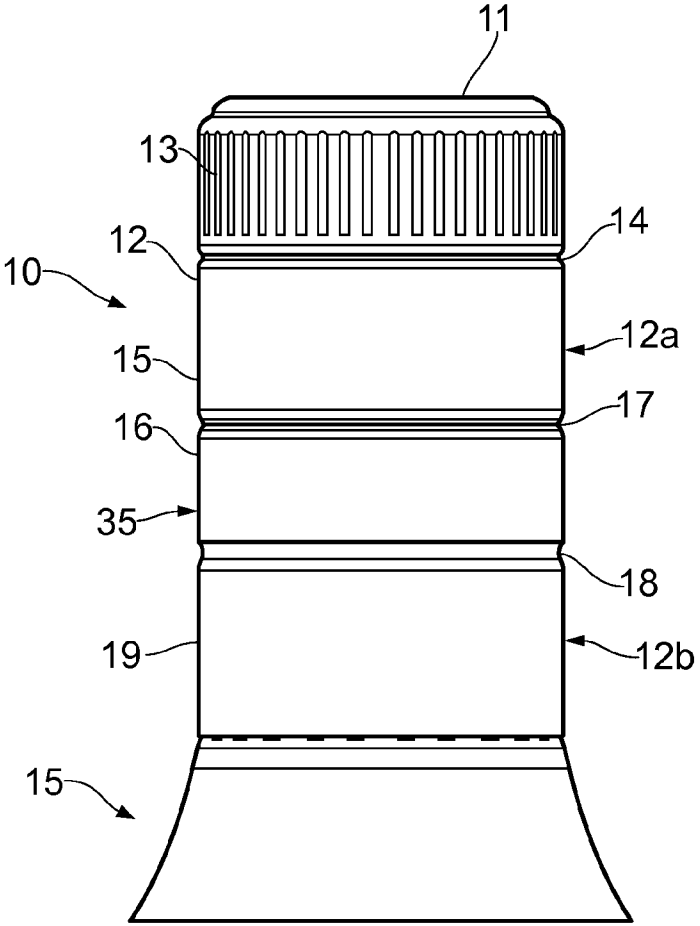
FIG. 1 is a side elevation of a tamper-evident closure formed according to the present invention and shown in an unopened position.
Figure 2:
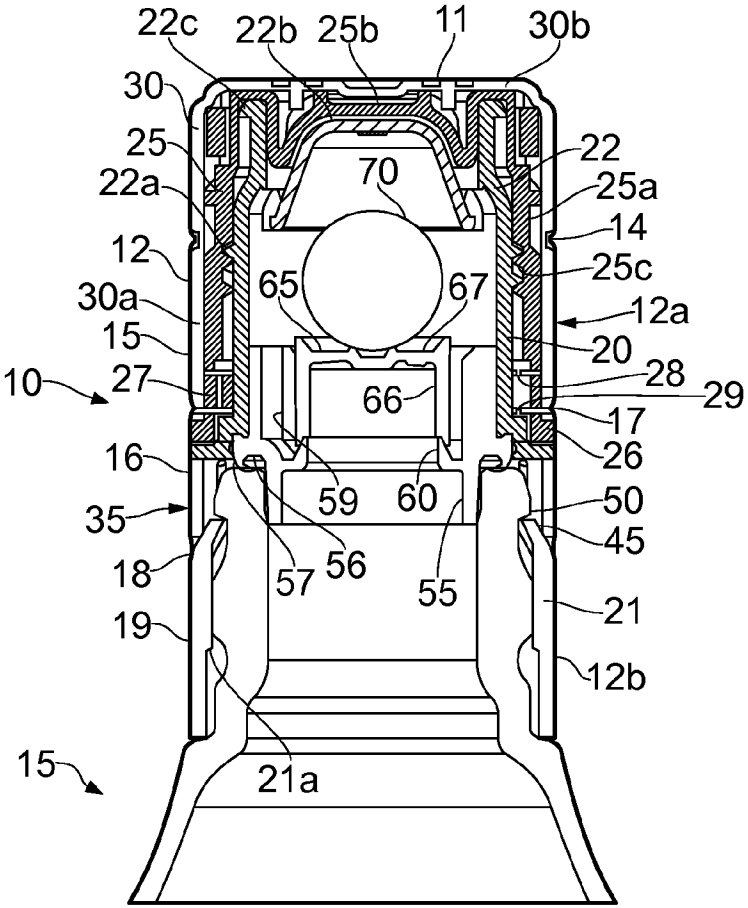
FIG. 2 is a section of the closure of FIG. 1.

Referring first to FIGS. 1 and 2 there is shown a closure generally indicated at 10 secured onto a container neck 15.

The closure 10 has an outer metal shell 35 which is generally cup-shape, having a disc-shaped top plate 11 and a generally cylindrical tubular sidewall 12 depending from the periphery thereof. Below the top plate 11, the sidewall 12 includes a plurality of longitudinally extending ribs forming a knurled region 13. Below the region 13 is a tuck-in bead 14 followed by two outward cylindrical regions 15, 16 divided by a tuck-in including a frangible line 17. The line 17 divides the shell into a first shell section 12*a* and a second shell section 12*b*. Below the region 16 is a further tuck-in bead 18 and the sidewall 12 terminates with cylindrical skirt 19 at its open end.

Internally the closure 10 comprises a pourer body 20, an inner part 25 and an outer part 30. Together the body 20 and the shell part 12*b* comprise a second portion and the inner and outer parts plus the shell part 12*a* comprises a cap-like first portion.

The body 20 comprises a lower engagement portion 21 and an upper flow regulation portion 22. The lower portion 21 comprises a generally cylindrical body having two diametrically opposed windows each of which has at a lower edge a ledge 45 for engagement under the container neck shoulder 50. In addition, the interior surface of the lower portion 21 has a plurality of mutually spaced axial ribs 21 a which lock onto the outer surface of the container neck in use to prevent relative rotation between the container neck and the body 20.

The upper portion 22 of the main body 20 is generally frusto-conical in shape and has external screw threads 22*a*. A dome-shape flow regulator 22*b* is positioned in the aperture. The aperture itself is defined by a circumferential pouring lip 22*c*.

The inner part 25 is generally cup-shape with a cylindrical side wall 25*a* closed at one end by a top plate 25*b* having a complementary shape to the main body aperture.

The interior of the part 25 includes internal screw threads 25*c* for engaging the pourer body threads 22*a*.

The free end of the part 25 is provided as a flange 26 which rests on the pourer body. One half of the tuck-in portion 17 of the shell below the frangible line is folded over the flange to retain it.

Between the sidewall and the flange a tear band 27 is provided and is connected to the wall 25*a* and the flange 26 by two lines of weakness formed by respective sets of frangible bridges 28, 29 so as to be removable.

The exterior of the inner part includes screw thread formations and ratchet formations 41 for engaging with the outer part as described below.

The outer part 30 is generally cup-shape and comprises a cylindrical side wall 30*a* and a top plate 30*b*.

The interior of the outer part includes screw thread formations and ratchet formations 43 for engaging corresponding formations on the inner part.

The exterior of the part 30 comprises a plurality of knurls (not shown) which help to lock it the knurled region of the shell part and to prevent relative rotation.

A valve housing 55 is clipped into the main body 20. The housing 55 comprises a generally cylindrical body having a circumferential sealing flange 56 with a depending sealing lip 57 (sometimes referred to as a "crab's claw") which seals against the top surface of the container neck mouth.

The interior of the housing 55 comprises a valve chamber having four locating ribs 59 and a valve seat 60.

A float valve 65 is housed in the housing 55 and can seal against a valve seat 60 to prevent re-filling of the container. The valve 65 comprises a generally cup-shape body comprising a cylindrical side wall 66 and a recessed top plate 67.

A valve control ball 70 is located on top of the float valve 65.

Operation of the closure is now described.

Figure 4:
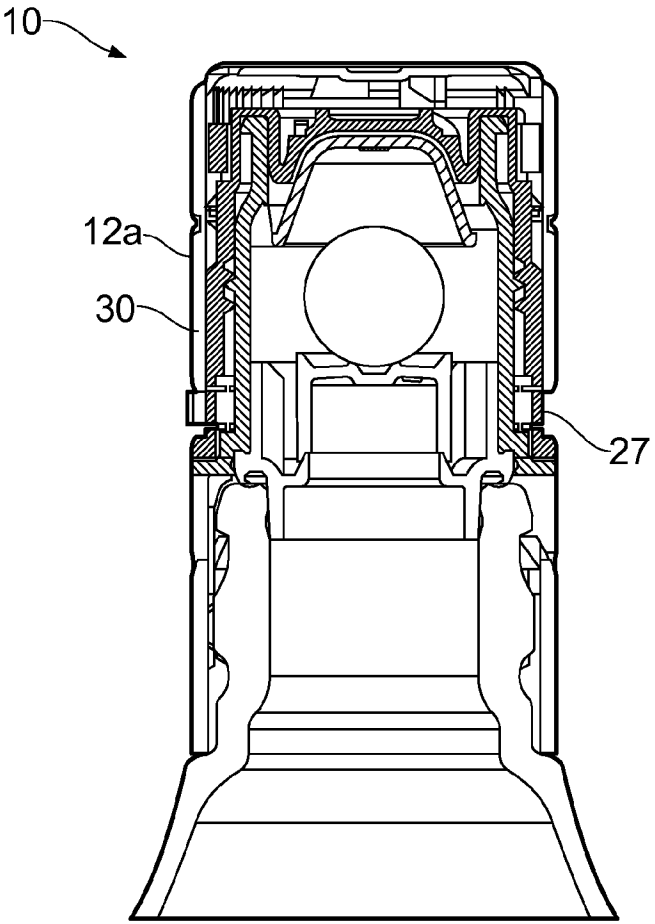
FIG. 4 is a section of the closure of FIG. 3.
Figure 3:
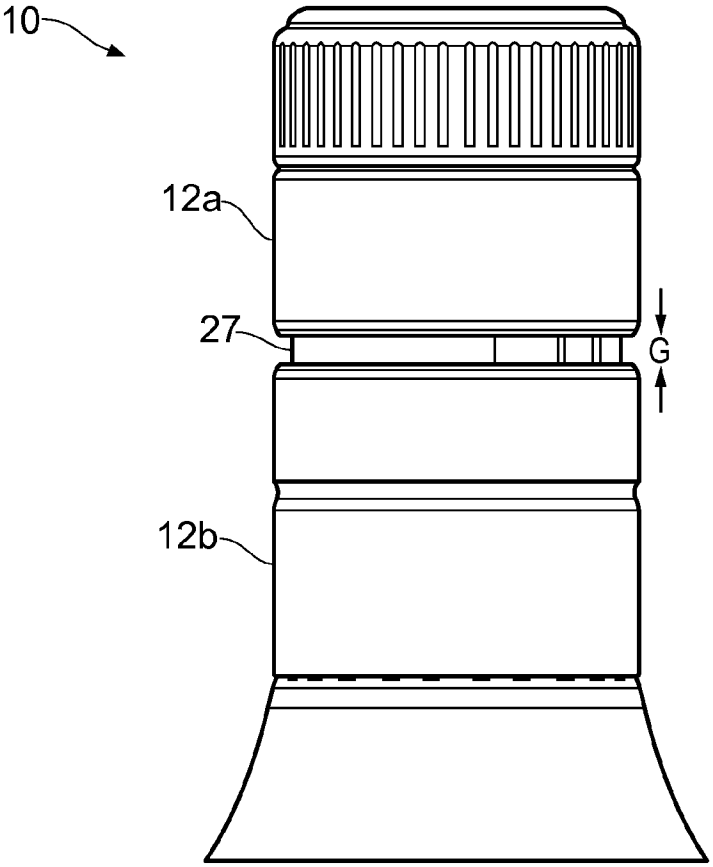
FIG. 3 is a side elevation of the closure of FIG. 1 shown following an initial opening event to form a gap.

The shell part 12*a* is grasped by a user and turned. This causes the outer part 30 to rotate relative to the inner part 25. The outer part is caused to rise as shown in FIGS. 3 and 4.

In this second position the open end of the outer part 30 has moved axially to expose the tear band 27 in a gap G now formed between the shell parts 12*a*, 12*b*. It will therefore be noted that the tear band is initially concealed and during this first opening phase is revealed from beneath the outer part and the shell.

The cap-like first portion still cannot be removed because the tear band 27 retains the inner part 25 by virtue of its connection to the flange 26 (which is retained under the tuck-in bead half) and the sidewall 25*a*.

Figure 6:
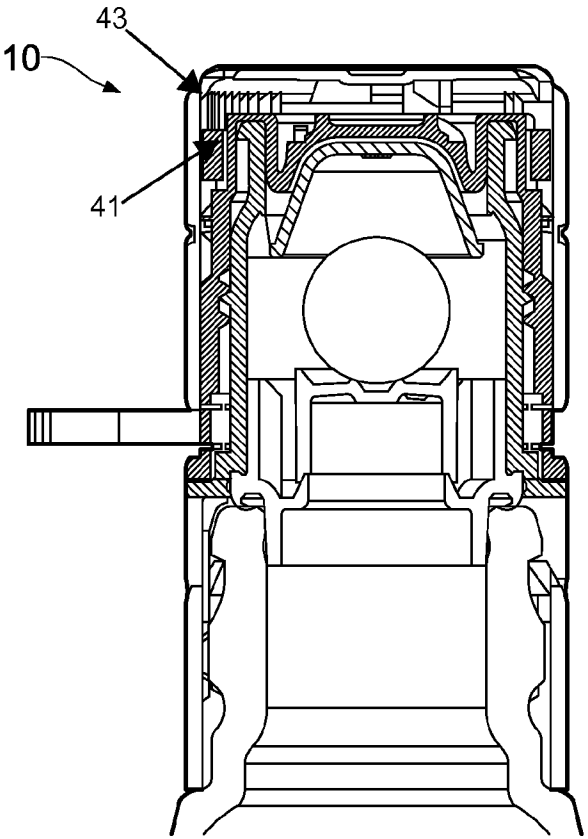
FIG. 6 is a section of the closure of FIG. 5.
Figure 5:
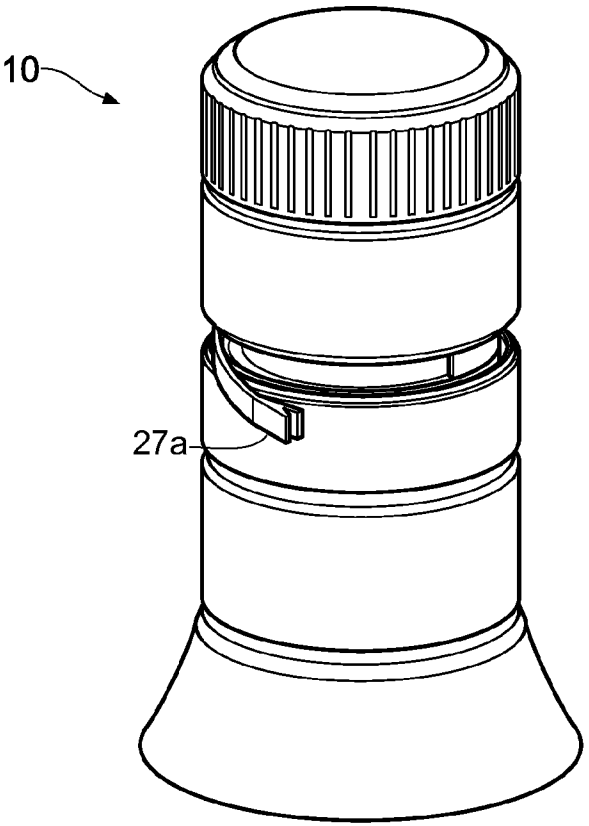
FIG. 5 is a perspective view of the closure of FIG. 3 shown during removal of a tear band.
Figure 8:
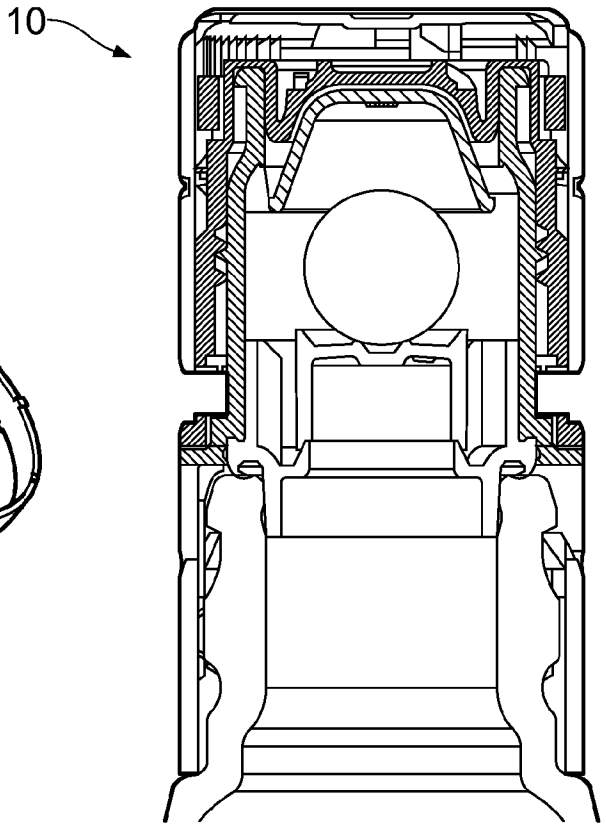
FIG. 8 is a section of the closure of FIG. 7.
Figure 7:
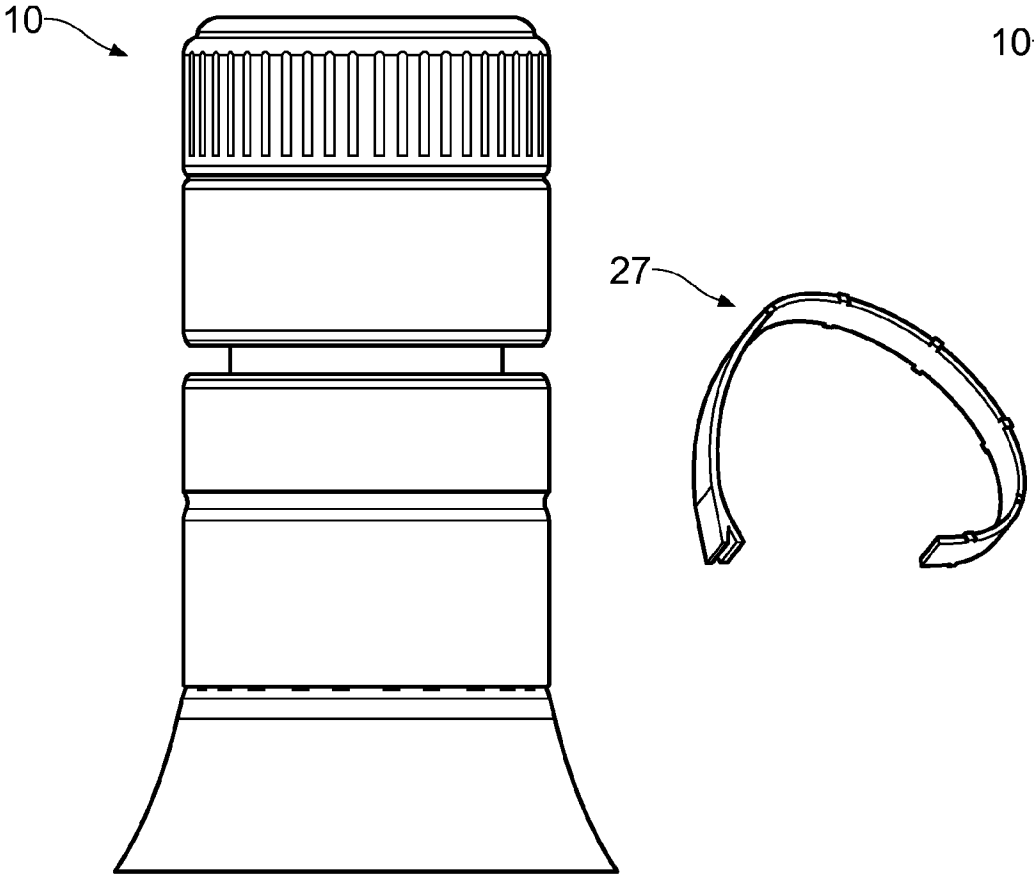
FIG. 7 is a side view of the closure of FIG. 5 shown following complete removal of the band.

As shown in FIGS. 5 and 6, the tear band 27 is provided with a tab 27*a* so that it can be grasped, pulled off circumferentially and removed as shown in FIGS. 7 and 8.

Figure 10:
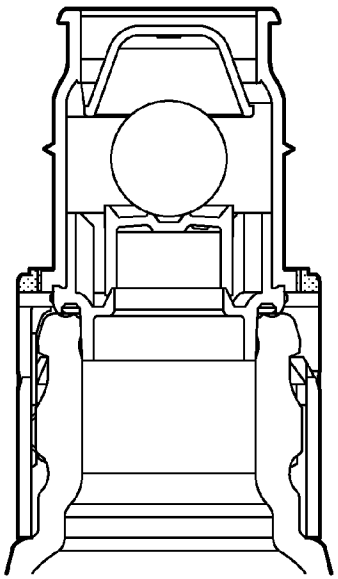
FIG. 10 is a section of the closure of FIG. 9.
Figure 9:
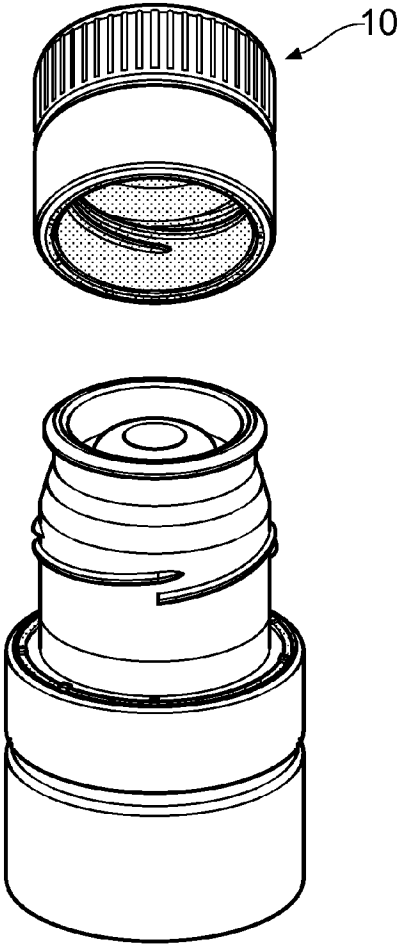
FIG. 9 is a perspective view of the closure of FIG. 7 shown with a top cap removed.

The cap part can now be lifted off the body 20 as shown in FIGS. 9 and 10 to allow the contents of the container to be dispensed. The contents are dispensed through the valve housing 55. The valve 65 lifts off the seat 60 as the container is upturned and the contents flow out. The valve 65 re-seals against the seat 60 under the weight of the ball 70 when the container is returned to an upright position. This prevents re-filling of the container.

Figure 11:
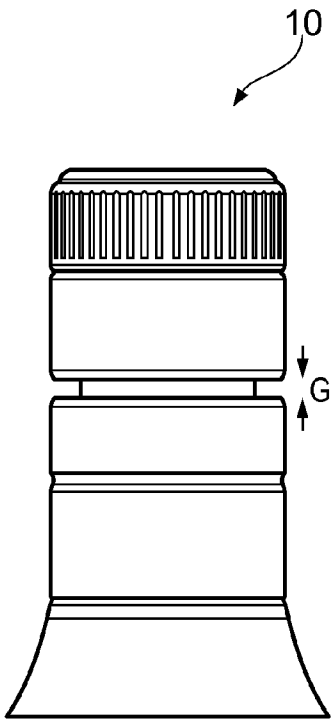
FIG. 11 is a side elevation of the closure of FIG. 9 shown following replacement of the top cap.

When the cap part is returned the inner part 25 is screwed back onto the body 20. The inner part screws back down to its original position, but the outer part 30 cannot because it is locked in position. This means that the gap G is permanently formed between the shell parts 12*a*, 12*b* with the pourer body 20 visible through it as shown in FIG. 11. This irreversible opening event provides visual evidence that the closure has been opened at least once.

Because in this embodiment the gap G between the metal shell parts 12*a*, 12*b* is not generated by placing an obstruction directly between them, it is not possible to close the gap G by a simple cutting operation.

Referring now to Figure there is shown a closure 110 formed according to an alternative embodiment. The closure is shown with the top cap removed for purposes of clarity.

Figure 13:
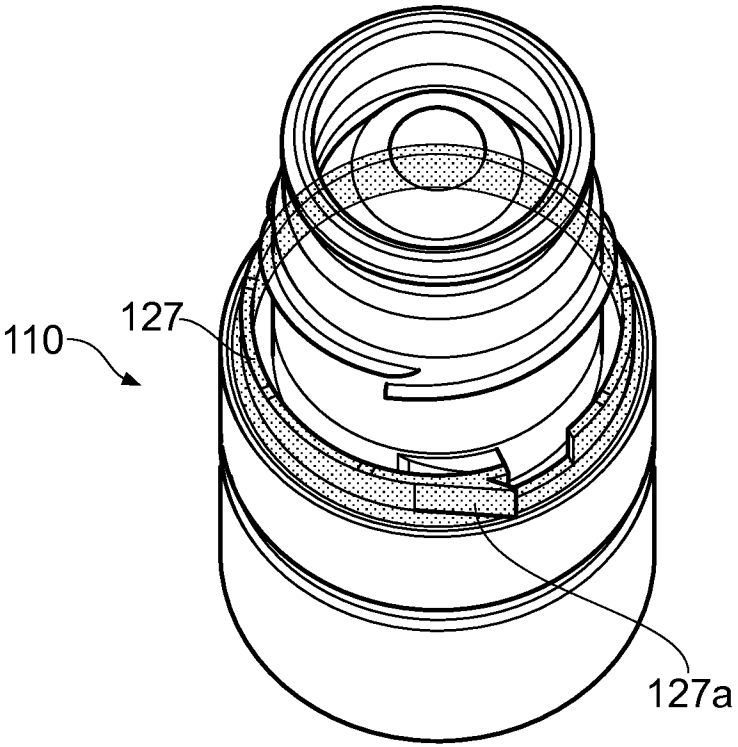
FIG. 13 is a perspective view of the closure of FIG. 12 shown following an initial rotation phase.
Figure 12:
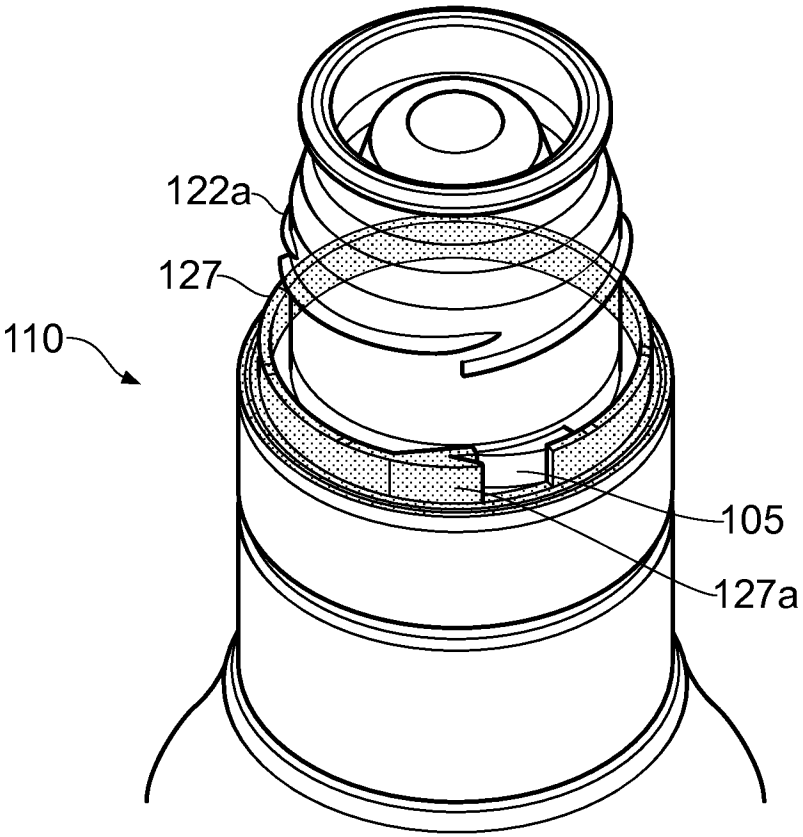
FIG. 12 is a perspective view of a closure formed according to an alternative embodiment and shown prior to an initial rotation phase.

The closure 110 is similar to the closure 10 illustrated in FIGS. 1 to 11. In this embodiment, however, the pourer body includes a ramp 105 and the inner part (not visible in FIGS. 12 and 13) is configured to allow a small amount of rotation relative to the body before it engages the screw threads 122*a* on the pourer body (which causes it to stop rotating and causes the outer part to start rotating as described above). This rotation causes the tear band pull tab 127*a* to ride up the ramp which pushes it radially outwards as shown in FIG. 13. In turn this makes it easier to grasp the tear band 127 for removal.

The description and drawings merely illustrate the principles of the invention. It will thus be appreciated that those skilled in the art will be able to devise various arrangements that, although not explicitly described or shown herein, embody the principles of the invention. Furthermore, all examples recited herein are principally intended expressly to be only for pedagogical purposes to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The invention claimed is:

1. A tamper-evident closure for a container, the closure comprising a first portion and a second portion, the first portion being connected or connectable to the second portion and removable therefrom, the closure movable upon a first opening from a first position in which the portions are in a first relative relation to a second position in which they are in a second relative relation, the closure comprising means for preventing the first and second portions from returning to the first position, in which the closure comprises a removable tear-band which attaches the first and second portions together such that the removable tear-band must be removed before the first portion is removable from the second portion, and in which in the first position the removable tear-band is concealed and in the second position the removable tear-band is revealed.

2. The closure as claimed in claim 1, in which the removable tear-band is caused to move from a first, retracted position to a second, extended position as the closure moves from the first to the second position to facilitate removal of the removable tear-band.

3. The closure as claimed in claim 1, in which the closure comprises a ratchet arrangement for preventing return to the first position.

4. The closure as claimed in claim 1, in which the closure comprises a shell and in which the first and second portions include respective first and second shell parts.

5. The closure as claimed in claim 4, in which the shell parts are joined by a line of weakness when the closure is in an unopened state.

6. The closure as claimed in claim 1, in which the second portion is attachable to a container.

7. The closure as claimed in claim 1, in which the second portion is attachable to a mouth and neck region of a container.

8. The closure as claimed in claim 1, in which the second portion is snap-fitable onto a container.

9. The closure as claimed in claim 1, in which the second portion comprises or includes a pouring fitment.

10. The closure as claimed in claim 1, in which the closure includes a one-way valve.

11. A tamper-evident closure for a container, the closure comprising a first portion including inner and outer parts, and a second portion, the first portion being connected or connectable to the second portion and removable therefrom, the inner and outer parts being movable upon a first opening of the closure from a first position to a second position in which there is a gap between at least part of the first and second portions, the closure comprising means for preventing the first portion from returning to the first position so as to maintain the gap, the closure comprising a removable tear-band which attaches the first and second portions together and holds the first portion captive such that the removable tear-band must be removed before the first portion is removable, in which the gap is obstructed.

12. The closure as claimed in claim 11, in which the closure includes means for preventing the inner part from moving relative to the second portion until the outer part has reached the second position.

13. The closure as claimed in claim 11, in which the closure comprises a shell and in which the first and second portions include respective first and second shell parts between which the gap is formed.

14. The closure as claimed in claim 13, in which the shell parts are joined by a line of weakness when the closure is in an unopened state.

15. The closure as claimed in claim 11, in which the second portion is attachable to a container.

16. The closure as claimed in claim 11, in which the closure comprises a ratchet arrangement for preventing return to the first position.

17. A tamper-evident closure for a container, the closure comprising:

a first portion including inner and outer parts, and a second portion, wherein the outer part is movable relative to the inner part from a first position in which the outer part is immediately adjacent the second portion to a second position in which there is an unobstructed gap therebetween, and wherein the inner and outer parts become irreversibly locked in the second position so that the outer part is not movable back to the first position to close the gap, and the closure further comprising a removable lock member which secures the first and second portions together and which is removable after the closure has been moved to the second position to allow removal of the first portion from the second portion.

18. The closure as claimed in claim 17, in which the second portion is attachable to a container.

19. The closure as claimed in claim 17, in which the closure comprises a ratchet arrangement for preventing return to the first position.

* * * * *